US005257904A

United States Patent [19]

Sullivan

[11] Patent Number: 5,257,904

[45] Date of Patent: * Nov. 2, 1993

[54] VOLUTE HOUSING FOR A CENTRIFUGAL FAN, BLOWER OR THE LIKE

[76] Inventor: John T. Sullivan, 3910 Madison St., Hyattsville, Md. 20781

[ * ] Notice: The portion of the term of this patent subsequent to Aug. 25, 2009 has been disclaimed.

[21] Appl. No.: 893,152

[22] Filed: Jun. 3, 1992

Related U.S. Application Data

[62] Division of Ser. No. 642,768, Jan. 18, 1991, Pat. No. 5,141,397.

[51] Int. Cl.[5] ..... F04D 29/42

[52] U.S. Cl. ..... 415/214.1; 415/206; 403/330; 403/11

[58] Field of Search ..... 415/182.1, 206, 214.1; 403/330, 11; 285/319, 921; 439/350, 357

[56] References Cited

U.S. PATENT DOCUMENTS

| | | | |
|---|---|---|---|
| 3,407,995 | 10/1968 | Kinsworthy . | |
| 3,491,550 | 1/1970 | Cavis . | |
| 3,856,431 | 12/1974 | Tucker . | |
| 3,874,191 | 4/1975 | Hudson . | |
| 4,026,624 | 5/1977 | Boag . | |
| 4,108,522 | 8/1978 | Favale . | |
| 4,132,489 | 1/1979 | Berg, Jr. et al. | 403/330 |
| 4,189,248 | 2/1980 | Sully | 403/11 |
| 4,392,759 | 7/1983 | Cook | 403/11 |
| 4,416,040 | 11/1983 | Towsley | 403/330 |
| 4,448,573 | 5/1984 | Franz . | |
| 4,509,898 | 4/1985 | Gormer | 403/11 |
| 4,599,042 | 7/1986 | Colliver | 415/214.1 |
| 4,836,063 | 6/1989 | Fushiya | 403/330 |
| 4,850,735 | 6/1989 | Hansen et al. | 403/330 |
| 4,850,894 | 7/1989 | Michot . | |
| 4,915,643 | 4/1990 | Samejima et al. . | |
| 4,919,592 | 4/1990 | Sears et al. . | |
| 5,141,397 | 8/1992 | Sullivan | 415/214.1 |

FOREIGN PATENT DOCUMENTS

| | | | |
|---|---|---|---|
| 1305648 | 8/1962 | France . | |
| 145497 | 7/1985 | Japan | 415/206 |
| 199011 | 8/1989 | Japan | 403/330 |
| 275563 | 8/1951 | Switzerland . | |
| 2209301 | 10/1989 | United Kingdom | 403/330 |
| 2224231 | 2/1990 | United Kingdom | 403/330 |

OTHER PUBLICATIONS

"Fan Engineering" by Richard D. Madison, Published by Buffalo Forge Co.

*Primary Examiner*—John T. Kwon

*Attorney, Agent, or Firm*—Diller, Ramik & Wight

[57] ABSTRACT

A volute housing is disclosed for use with a centrifugal fan, blower or the like, and includes a housing body defined by opposite spaced sidewalls, a volute peripheral wall disposed between the sidewalls and defining therewith and with an impeller a volute chamber, and the sidewalls each having a generally minimum radial dimension located at a tongue of the volute chamber which progressively increases to a maximum radial dimension located at a throat of the volute chamber. The sidewalls include first sidewall portions which are generally parallel to each other between the tongue and a transition zone 180° therefrom, and second sidewall portions of the sidewalls from the transition zone to the volute throat at approximately 360° are in diverging relationship in a direction away from the transition zone whereby fluid/air flowing through the housing body expands progressively axially outwardly as it flows between and along the second sidewall portions.

20 Claims, 7 Drawing Sheets

101
103
F
R1
R2
104
102
F
R
C
100
100
17
15
16
46
46
45
45
73
41
51
R
62
61
41
13
16
15
73
15
17
11
10

10
13
79
89
12
14
89
11
79
61
62
R
41
42
51
A
52
75
76
100
74
79
89
77
78
73
75'
81
42
61
62
76'
41
R1
100
R
100
R2

10
11
13
14
15
16
17
21
22
23
24
25
26
30
31
32
33
34
35
41
42
44
45
46
60
61
62
72
73
74
80
81
100
A
B
R
T
0°
180°
360°

VOLUTE HOUSING FOR A CENTRIFUGAL FAN, BLOWER OR THE LIKE

This application is a division of application Ser. No. 07/642,768, filed Jan. 18, 1991 and now U.S. Pat. No. 5,141,397.

BACKGROUND OF THE INVENTION

This invention is directed to a volute housing for a centrifugal fan, blower or the like. The theory, design and application of such centrifugal fans can be found in the publications entitled "Turboblowers" by Alexey Joakim Stepanoff, published by John Wiley & Sons, Inc. and available at the Library of the University of Maryland, College Park, Maryland and "Fan Engineering" by Richard D. Madison, published by Buffalo Forge Company, Buffalo, N.Y. (copyright 1949) and also available at the latter noted library. These publications describe several volute housing designs, including a constant velocity volute which is said to be the most favorable for efficiency because of the alleged fact that at the best efficiency point pressure is uniform around the volute. The latter condition is said to be the most desirable for impeller performance. In this design the entire recovery of the kinetic energy into pressure takes place in the volute nozzle which is preferably of a diverging relationship with the included angle being established experimentally at 8° for a circular cone to obtain the most efficient velocity convergent through the nozzle, though a range of 6° to 10° is acceptable. Beyond 10° efficiency is adversely affected. However, in such constant velocity volute housings, the volute pressure is constant until released by the discharge nozzle. The disadvantage of such constant velocity volute housings is that the capacity must be maintained at all times at its rated capacity, otherwise at partial capacities, pressure increases toward larger volute sections and decrease toward smaller volute sections. This decreases efficiency and increases noise.

In an abbreviated volute housing about one-quarter of the impeller periphery discharges directly into the discharge opening without establishing normal volute pressure and velocity distribution prevailing in the remaining three-quarters of the controlled volute housing section. The disadvantage is that the average volute velocity may only be one-half of the absolute velocity at the impeller discharge. Thus sound is decreased but so too is efficiency.

In both the normal volute casing and the abbreviated volute casing, the sidewalls are substantially parallel to each other throughout and it is the peripheral volute wall which progressively diverges from the circular fluid inlet openings in a direction away from the cut-off point or tongue to the volute throat. Essentially, the volute peripheral wall ends at the volute throat and the volute throat defines the initiation or entrance of the discharge nozzle. It is in the area downstream of the throat that the discharge nozzle sidewalls are flared in a direction diverging away from each other in the direction of fluid travel. Such flaring can extend slightly downstream of the volute throat. Such volute casings or housings are generally constructed from galvanized metal and the divergent sidewall angles are extremely abrupt (20°–45°) resulting in excessive turbulence and swirling of discharge fluid/air with an attendant increase in noise.

Another volute housing includes typical circular fluid inlet openings, a volute peripheral wall and sidewalls which continuously diverge from the cut-off point or tongue in the direction of fluid flow to the throat and beyond the discharge nozzle to the discharge opening or orifice. A volute housing so constructed is found in U.S. Pat. No. 3,491,550 in the name of Thomas C. Cavis issued Jan. 27, 1970. This construction increases the RPM's only, and effects expansion from the throat or cut-off point through 360° which basically creates a sound amplification structure typical of the curvature found in a tuba or a french horn. This creates a low bass hum which amplifies the highest sound at the compression point or tongue which is the area of maximum (and virtually only) compression.

From the foregoing, each of the volute housings known suffer from two main disadvantages, namely, (a) low efficiency and (b) high noise.

SUMMARY OF THE INVENTION

In keeping with the foregoing, a primary object of the present invention is to provide a novel volute housing which is (a) highly efficient and (b) quiet.

The novel volute housing of the present invention includes a housing body defined by opposite spaced sidewalls, a generally circular fluid inlet opening in each sidewall with the fluid inlet openings having a coincident axis and a volute peripheral wall disposed between the sidewalls. The sidewalls each have a generally minimum radial dimension located at a first zone (throat/-cut-off area) which progressively increases to a maximum radial dimension located at a second zone (volute throat). The arcuate distance between these first and second zones is generally 360°, and to this extent the volute housing just described constitutes a normal volute housing. However, in keeping with this invention the sidewalls each have first and second sidewall portions with a first sidewall portion of each sidewall extending arcuately from the first zone (cut-off point-/tongue) generally 180° to a transition zone, and over this arcuate extent the first sidewall portions are generally parallel to each other. The sidewalls also have second sidewall portions which extend arcuately from the transition zone to the volute throat, and in keeping with the invention, the second sidewall portions are in diverging relationship in a direction away from the transition zone to the volute throat whereby fluid flowing through the housing body in a direction from the transition zone toward the throat expands progressively axially outwardly as it flows between and along the second sidewall portions. This construction increases the efficiency of the volute housing and appreciably lessens sound/noise.

In further accordance with the present invention the housing body is preferably constructed from a pair of housing parts joined to each other along a radial plane generally normal to the coincident axis and between the sidewalls. Thus, the two housing parts can be rapidly interconnected to each other, preferably by cooperative male and female fasteners.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIGS. 6(*a*), 6(*b*), and 6(*c*) are the exploded fragmentary cross sectional view of one of several pairs of male and female fasteners, and illustrates the progressive sequence for snap-securing the same to each other.

DESCRIPTION OF THE PREFERRED EMBODIMENT

Figure 1:
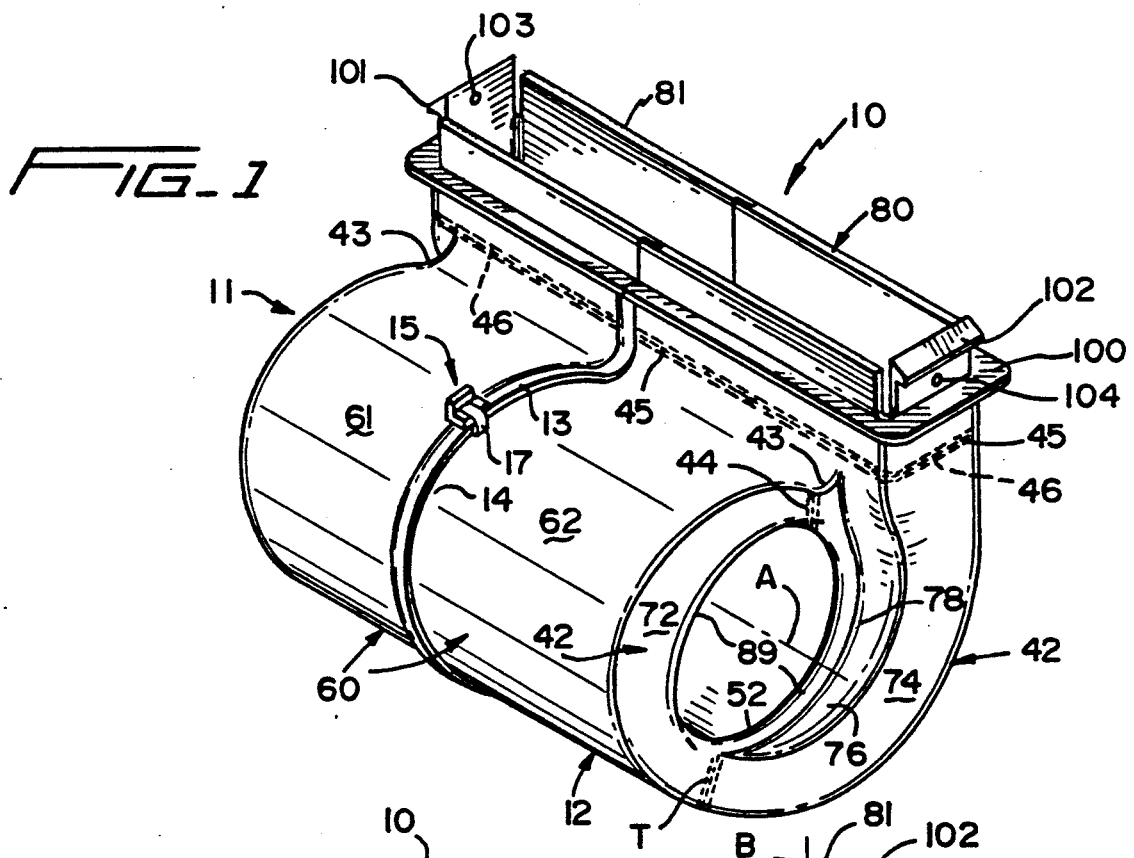
FIG. 1 is a perspective view of a novel volute housing constructed in accordance with this invention particularly adapted for utilization with a centrifugal fan, blower or the like, and illustrates a volute peripheral wall, a pair of sidewalls associated therewith, circular fluid inlet openings associated with each sidewall, and a sidewall portion which diverges progressively axially outwardly and in the direction of fluid flow between a transition zone (180°) and a volute throat (generally 360°).

A volute housing for a centrifugal fan, blower or the like is best illustrated in FIGS. 1–5 of the drawings and is generally designated by the reference numeral 10.

The volute housing 10 includes a housing body defined by a pair of housing parts or halves 11, 12. The housing parts 11, 12 are joined to each other along a generally radial plane R (FIGS. 3 through 5) through interlocked edges 13, 14 (FIGS. 3 and 4).

Figure 7:
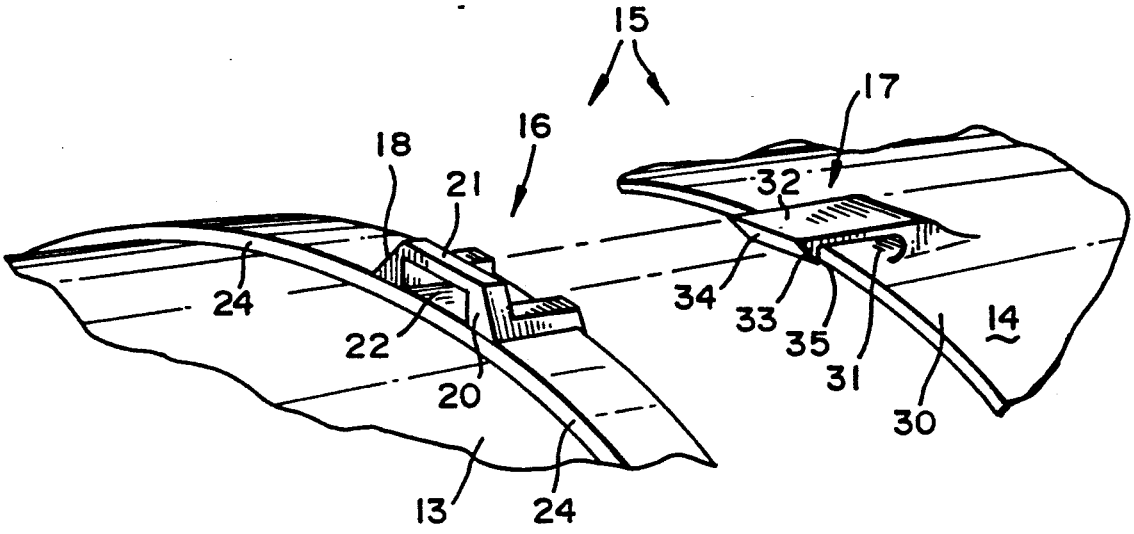
FIG. 7 is a fragmentary perspective view of two housing body parts of the volute housing body, and illustrates the axial alignment of a male and female fastener prior to securing the same to each other.
Figure 8:
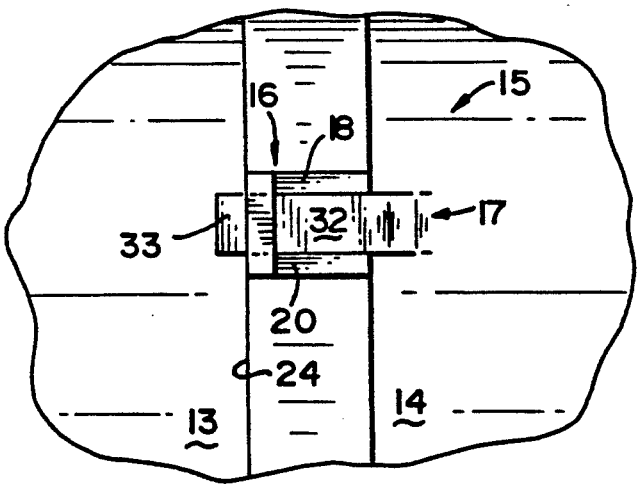
FIG. 8 is a reduced fragmentary elevational view of the snap fasteners of FIG. 7 and illustrates the male and female snap fasteners in assembled snap-secured relationship to each other.

The edges 13, 14 carry pairs of fasteners 15 defined by female fasteners 16 carried by the edge 13 and male fasteners 17 carried by the edge 14 (FIGS. 2, 3, 6–8). The female fasteners 16 include a pair of radially projecting spaced legs 18, 20 (FIG. 2) spanned by a bridge 21 and collectively defining a female opening 22. An undersurface 23 of the bridge 21 is curved to define a converging entrance (unnumbered) of the female opening 22. To the left and below each female opening 22, as viewed in FIGS. 6 and 7, is a ledge 24. Projecting to the right of the ledge 24, again as viewed in FIGS. 6 and 7, is an offset projection or nose 25 defining a terminal end of the edge 13 and a generally internal peripheral recess 26 thereof. A terminal end 30 of the edge 14 (FIGS. 6 and 7) is spaced by a gap or space 31 from a tongue or projection 32 ending in a radially inwardly directed locking lip 33. The locking lip 33 has an angled entrance surface 34 and a locking surface 35 which lies in a plane generally normal to an axis A (FIG. 2) of the volute housing parts 11, 12 and generally circular fluid inlet openings 51, 52 in respective sidewalls 41, 42 (FIGS. 1–4). The width of the tongue 17 corresponds to the width of the female opening 22 (see FIG. 8) and the thickness of the nose 25 corresponds to the radial width of the gap 31.

Figure 2:
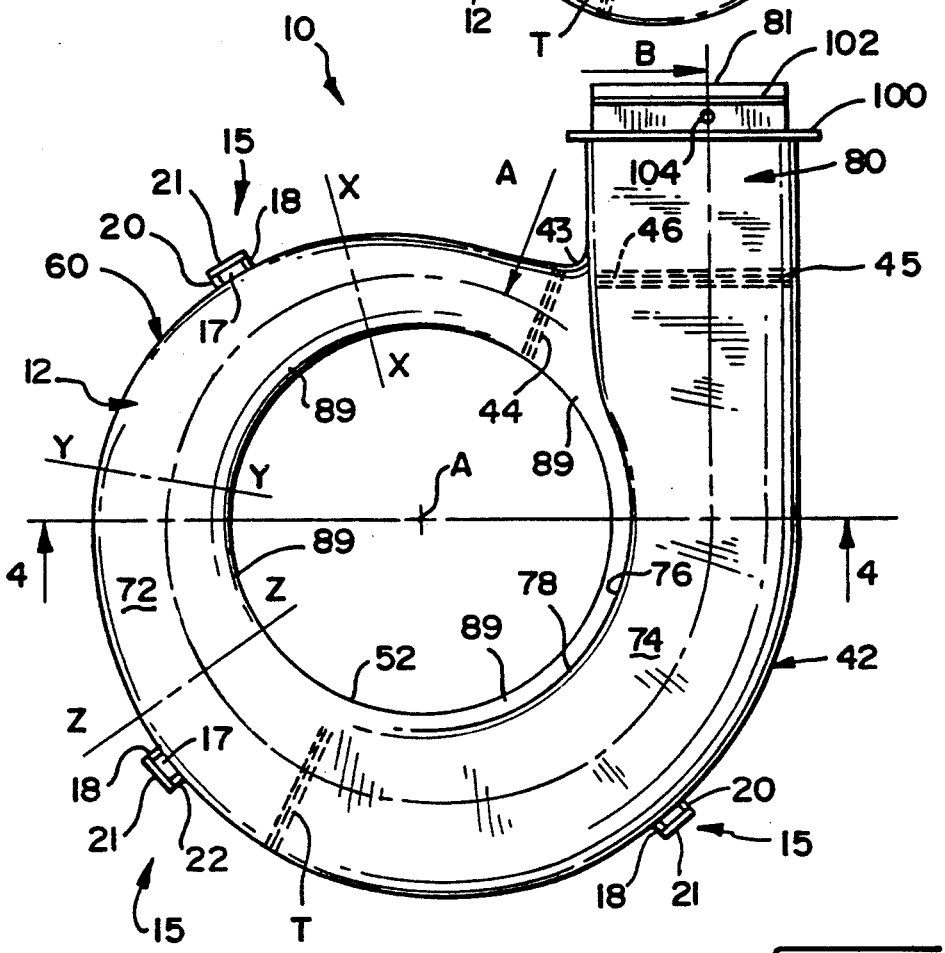
FIG. 2 is an enlarged side elevational view of the volute housing of FIG. 1, and illustrates structural details of the volute housing.
Figure 3:
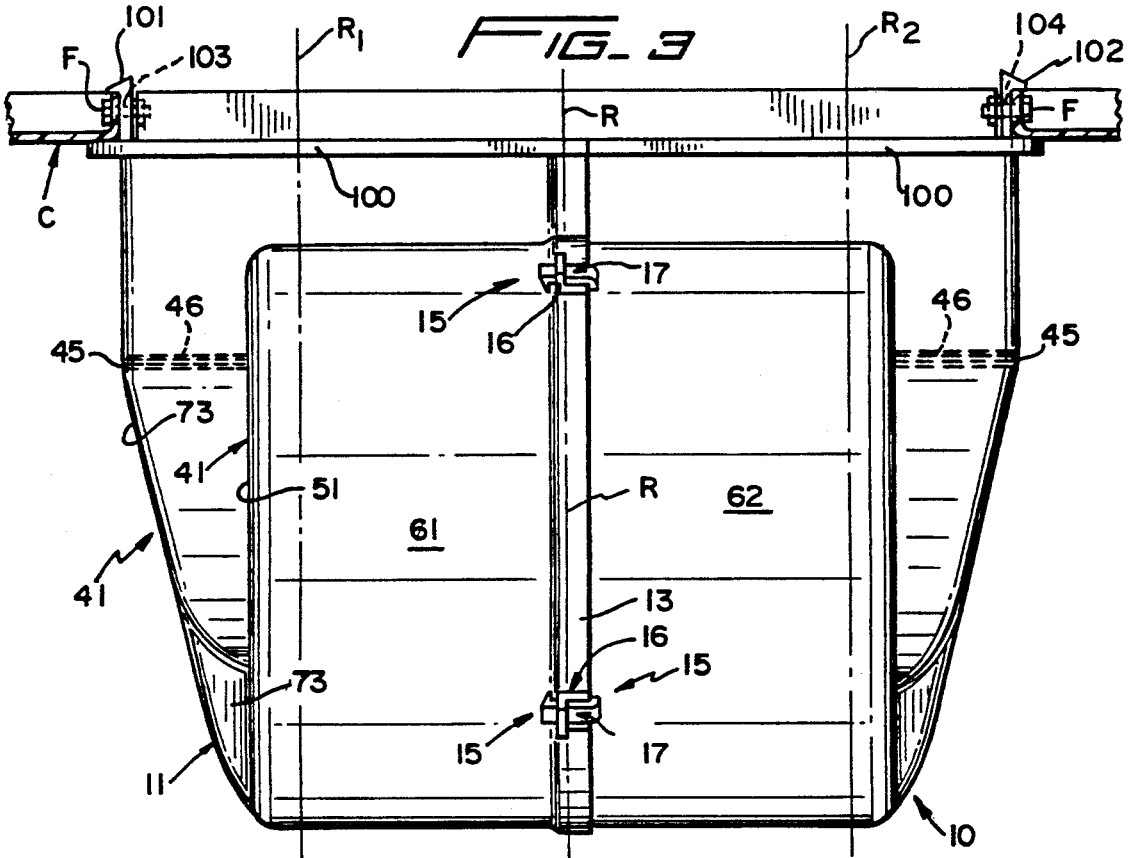
FIG. 3 is an enlarged perspective view of the volute housing of FIGS. 1 and 2, and illustrates the construction thereof from two housing parts snapped together by male and female fasteners with the volute housing being snap-secured in an opening of a convector tray or pan of a fan coil unit.
Figure 4:
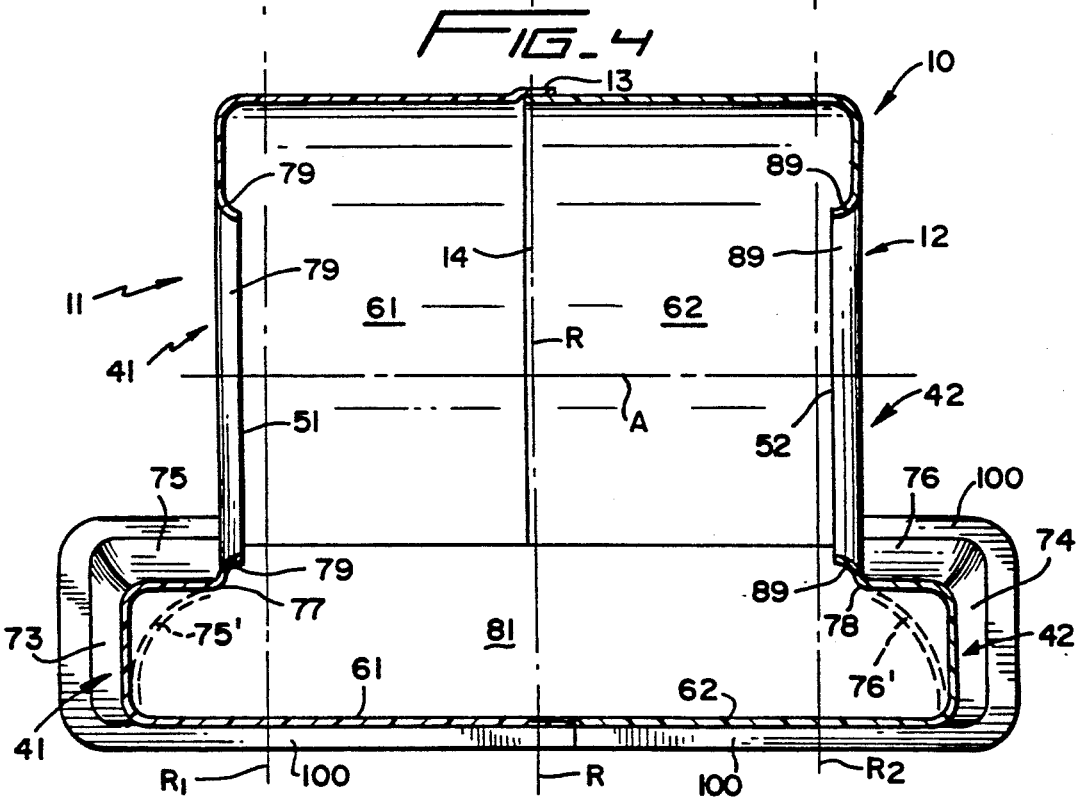
FIG. 4 is an enlarged cross sectional view taken generally along line 4—4 of FIG. 2, and illustrates the manner in which the sidewall portions of the volute housing body between approximately 180° and 360° diverge in a direction away from each other relative to the direction of fluid travel and toward the discharge nozzle opening.

In order to assemble the housing parts 11, 12 into the volute housing 10 to the configuration shown in FIGS. 1 through 3, the two halves 11, 12 are aligned with each other with each of the tongues 32 aligned with an associated female opening 22 in the manner shown in FIG. 6 (left-hand-most illustration). The two halves 11, 12 are then moved toward each other at which time the surface 34 moves along the nose 25 and is deflected slightly upwardly thereby eventually contacting the divergent portion (unnumbered) of the undersurface 23 of the bridge 21 as the nose 25 moves into the gap 31 (FIG. 6, center illustration). In this fashion the bridge 21 prevents the tongue 32 from being deflected excessively upwardly, and when finally mated, the inherent resilience of the tongue 32 causes the same to rebound to the right-hand-most position shown in FIG. 6 at which time the locking surface 35 abuts against the ledge 24. In order to unlock the housing parts 11, 12 and disassemble the volute housing 10, the tongues 32 are deflected upwardly sufficiently for the surfaces 35 to clear the ledges 24 which is controlled by the undersurface 23 of the bridge 21. The bridge 21 also prevents each tongue 32 from being deflected excessively and being broken during the disengagement of the surfaces 35 from the ledges 24. Once the latter disengagement occurs, the housing parts 11, 12 can be simply pulled apart to disassemble the same.

The volute housing 10 includes a volute peripheral wall 60 defined by a volute peripheral wall portion 61 of the volute housing half or part 11 and a volute peripheral wall portion 62 of the volute housing part 12. The volute peripheral wall 60 extends generally from a volute tongue or cut-off 43 which is located generally at a first zone 44 of minimum radial dimension or distance relative to the openings 51, 52 to a second zone 45 located at a volute throat 46. The direction of fluid flow is counterclockwise relative to the volute peripheral wall 60, as viewed in FIG. 2, and as is best illustrated in FIG. 2, the sidewall 42 progressively increases in radial size in the direction of fluid travel from the first zone 44 of minimum radial dimension to the second zone 45 of maximum radial dimension. The arcuate distance between the first zone 44 and the volute tongue or cut-off point 43 and the second zone 45 or volute throat 46 in the direction of fluid flow is generally 360° (FIGS. 2 and 6).

Figures 5, 6A, 6B, 6C:
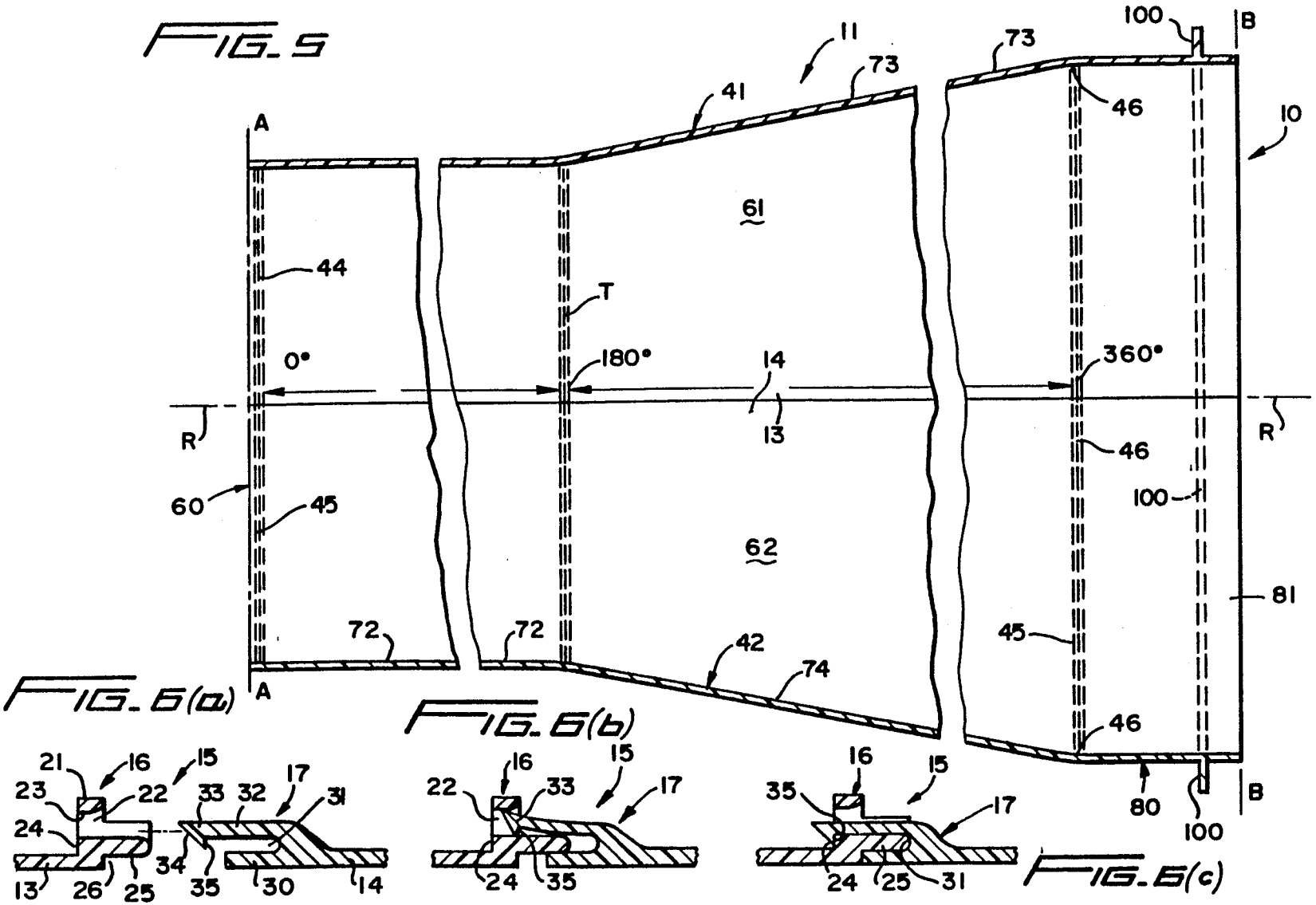
FIG. 5 is a cross sectional view taken generally along the line A-B of FIG. 2 and laid out in a flat plane, and illustrates the generally parallel relationship of a first pair of sidewall portions between a tongue or cut-off point (0°) and a transition zone 180° removed, and the divergent relationship of a pair of second sidewall portions between the transition zone (180°) and another zone (throat) 360° from the cut-off point/tongue.

Each of the sidewalls 41, 42 includes respective first sidewall portions 71, 72 and second sidewall portions 73, 74. The first sidewall portions 71, 72 are in generally parallel relationship to each other (FIG. 5) and extend approximately 180° from the first zone 44 to a transition zone T (FIGS. 2 and 5). As viewed in FIGS. 2 and 5, the transition zone T is located approximately 180° from the first zone 44 and tongue 43, as measured counterclockwise in FIG. 2. Thus, fluid/air flow between generally the tongue or cut-off 43 and the first zone 44 up to the transition zone T will be confined radially against expansion by the generally parallel sidewall portions 71, 72. After the transition zone T and up to the second zone 45/volute throat 46, the second wall portions 73, 74 diverge away from each other in the direction of fluid flow, as is best illustrated in FIG. 5. Thus, the fluid/air travelling from the transition zone T to the volute throat 46/second zone 45 will expand radially outwardly eventually exiting through a generally polygonal discharge nozzle 80 having a discharge opening 81. The cross sectional configuration at the volute throat 46 corresponds to the cross sectional configuration of the discharge opening 81 of the discharge nozzle 80, and thus between the volute throat 46 and the discharge opening 81, no further expansion of the fluid/air takes place.

Axial transition walls 75, 76 (FIGS. 1 through 4) bridge between the respective openings 51, 52 and the second sidewall portions 73, 74, respectively, of the sidewalls 41, 42, respectively. The axial transition walls 75, 76 merge very abruptly with the respective second sidewall portions 73, 74 at sharp radii or radius portions 77, 78, respectively (FIGS. 1, 2 and 4). The radii 77, 78 are relatively abrupt (FIG. 4) and merge with less abrupt radii or radius portions 79, 89, respectively (FIGS. 1, 2 and 4). The axial transition walls 75, 76 and the respective radii 77, 78 begin at the transition zone T and progressively widen radially (see FIG. 1) to the volute throat 46/second zone 45. While the abrupt radii 77, 78 extend generally only between the transition zone T to the volute throat 46/second zone 45, the less abrupt radii 79, 89 extend a full 360° about the respective openings 51, 52 (FIGS. 1 and 4). Because of the latter construction a continuous uniform circumferential inlet cap is formed between an impeller (not shown) associated with the volute housing 10 and the gradual radii 79, 89 thereof. This causes uniform circumferential air flow into the volute housing 10 which balances not only the air flow, but in turn balances the torque on the impeller, its shaft and the associated drive motor (not shown) resulting in minimal vibration. The transition walls 75, 76 are generally in parallel relationship to the portions of the volute peripheral wall portions 61, 62 radially opposite thereto. Accordingly, as fluid/air flows between the transition zone T and the volute throat 46/second zone 45, the fluid/air can expand radially outwardly because of the divergent nature of the second wall portions 73, 74 but is constrained against radial expansion until reaching the volute throat 46/second zone 45.

From the foregoing, the radial cross section through the first zone 44 defines the minimum cross sectional volume of the volute fluid chamber (unnumbered) with, of course, the fluid chamber being established generally as that volume between the volute peripheral wall 60 and the inlet openings 51, 52 or the outer periphery of an impeller (not shown) mounted in the volute housing 10. This cross sectional volume progressively increases in the direction of fluid/air flow as, for example, in the direction of selected radial planes X-X, Y-Y, Z-Z, etc. until reaching a maximum at the transition zone T. However, during the enlargement of the volumes between generally 0° and 180°, all of the enlargement of chamber volume is through radial expansion and not through axial expansion because of the generally parallel relationship of the first sidewall portions 71, 72 of the respective sidewalls 41, 42. However, the cross sectional volume of the air/fluid chamber beginning at the transition zone T progressively increases toward the second zone 45/volute throat 46, not only radially but also axially, because of the progressive divergence of the second sidewall portions 73, 74 toward and to the volute throat 46/second zone 45. At the latter zone the cross sectional volume remains generally unchanged as it passes through the discharge nozzle 80 exiting the discharge opening 81 thereof. Due to the divergence of the second sidewall portions 73, 74 in conjunction with the transition walls 75, 76 between the transition zone T and the second zone 45/volute throat 46, the efficiency of the overall volute housing 10 is increased while the noise/sound is decreased even though uniform compression is maintained only over approximately 0°–180° from the first zone 44 to the transition zone T. However, releasing the compression and providing expansion from the transition zone T toward discharge particularly in an axial direction, has achieved efficiency beyond that heretofore obtained at noticeably decreased noise levels.

The volute housing 10 is also provided with an abutment flange 100 (FIGS. 1 and 3) which extends about the exterior of the discharge nozzle 80 downstream from the discharge opening 81. The flange 100 abuts against the bottom of a convection tray C (FIG. 3) in the manner fully described in applicant's pending Application Ser. No. 07/459,221 filed Dec. 29, 1989, entitled "A Fan Coul Unit, and issued Aug. 27, 1991 under U.S. Pat. No. 5,042,269." The specifics of the latter, including details of oppositely directed connected tongues or flanges 101, 102 are herein incorporated by reference. However, in addition to the flanges or tongues 101, 102, openings 103, 104 are formed in the discharge nozzle 80 immediately adjacent and below each of the flanges or tongues 101, 102 through which fasteners F (FIG. 3) 102 through which fasteners F (FIG. 3) can be connected to suspendingly secure the volute housing 10 to the convector tray C.

Reference is now made to FIG. 4 which illustrates a modification of the invention in which transition walls 75', 76' are not parallel to the volute peripheral wall 60 but instead are modified to gradually flare from the respective openings 51, 52 toward the respective volute peripheral wall portions 61, 62 of the volute peripheral wall 60. The transition walls 75', 76' now gradually blend with the transition radii 77, 78 between the transition walls 75', 76' and the less abrupt radii 79, 89, respectively, resulting in less cavitation, less noise and still greater efficiency than the more abrupt (90°) transition earlier described between the walls 73, 75 and 74, 76.

Figure 9:
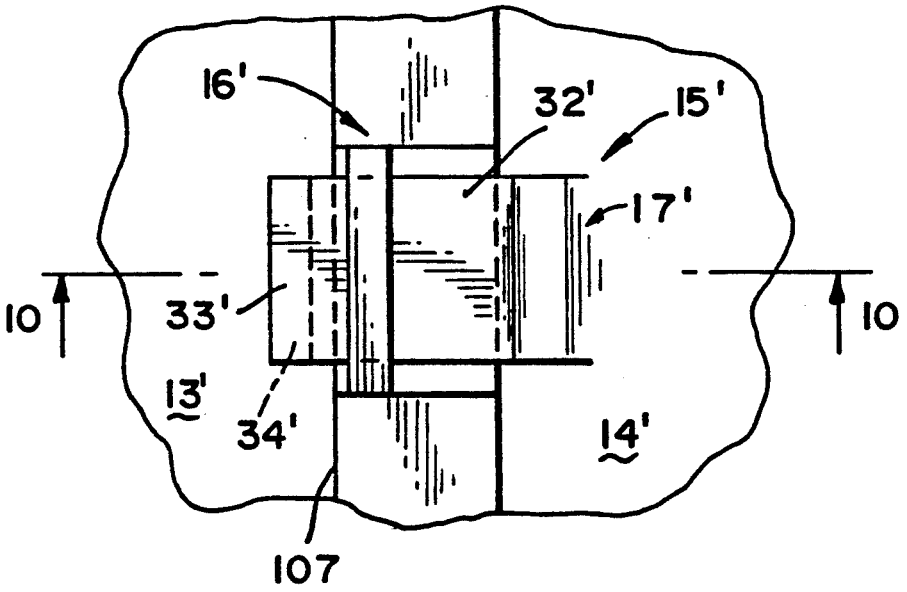
FIG. 9 is a fragmentary elevational view of another pair of male and female snap fasteners, and illustrates the fasteners in secured relationship to each other.
Figure 10:
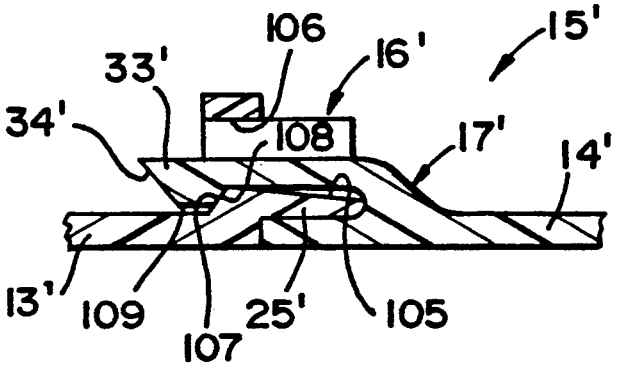
FIG. 10 is a fragmentary cross sectional view taken generally along line 10—10 of FIG. 9, and illustrates details of the secured fasteners.
Figure 11:
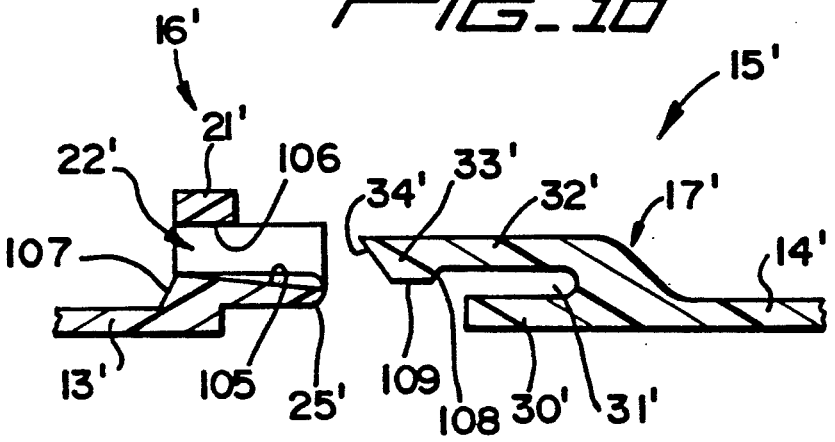
FIG. 11 is a fragmentary cross sectional view similar to FIG. 10 and illustrates the snap fasteners in unfastened relationship to each other.

Reference is now made to FIGS. 9 through 11 of the drawings which illustrates another pair of fasteners 15' which have been primed to designate structure substantially identical to that of the pairs of fasteners 15. In this case a female fastener 16' includes an offset projection or nose 25' but an upper surface 105 thereof is inclined downwardly and to the right, as viewed in FIGS. 10 and 11. An undersurface 106 of a bridge 21' is not provided with a converging entrance surface, as in the case of the undersurface 23 of the bridge 21. Furthermore, a ledge 107 is slightly inclined upwardly and to the right as viewed in FIGS. 10 and 11, as opposed to the generally normal disposition of the ledge 24 relative to the edge 13 of the female fastener 16 (FIG. 6). The male tongue or projection 32' includes a locking lip 33' and a forward inclined surface 34'. However, a rearward surface 108 is inclined and a bottommost surface 109 is generally flat. Thus the locking lip 33' is not pointed, as in the case of the locking lip 33 of FIG. 6.

In order to fasten the fasteners 16', 17', the tongue 32' is moved to the left, as viewed in FIG. 11, and the surface 109 is progressively guided by the surface 105 to feed the locking lip 33' through the female opening 22' which also progressively deflects the tongue 32' upwardly toward and against the underside 106 of the bridge 21'. The bridge 21' prevents the tongue 32' from being over deflected during this fastening operation, and once the locking lip 33' moves beyond the female opening 22', the surfaces 107, 108 lockingly engage each other (FIG. 9) with sufficient force to maintain the fastening means 15' assembled. However, since the surfaces 107, 108 are inclined, release thereof is easier than that heretofore described in conjunction with the surface 35 and ledge 24 of the pair of fasteners 15 which are generally normal to the direction of disassembly. The latter is readily apparent by merely comparing FIG. 10 with the right-hand-most illustration of FIG. 6. However, even with the tapered surfaces 107, 108, the grip is sufficiently adequate to assure that the volute housing 10 is maintained in its assembled condition.

Figure 12:
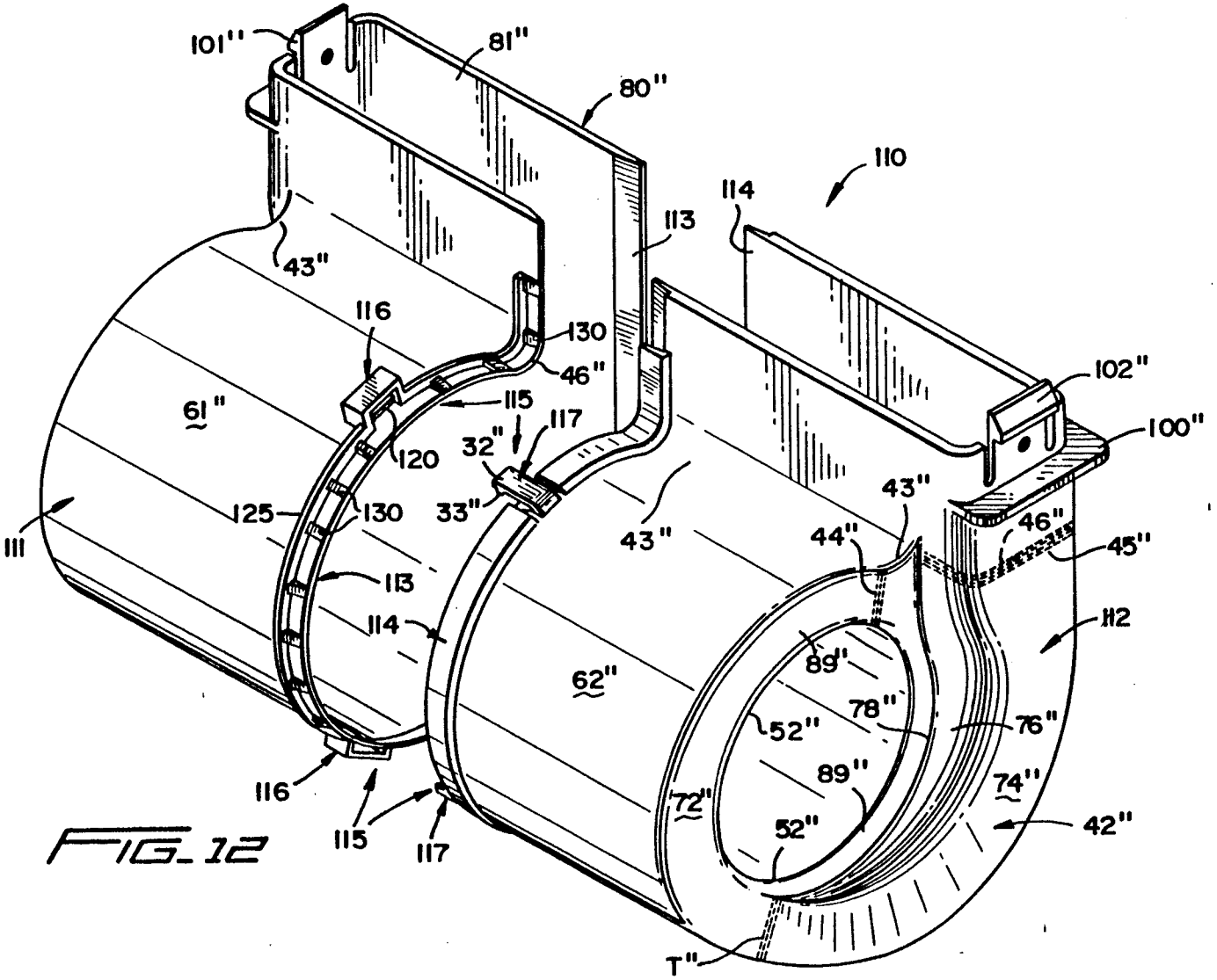
FIG. 12 is a perspective view of another novel volute housing constructed in accordance with this invention, and illustrates a pair of volute housing bodies or parts having peripheral edges adapted to be snap-fastened to each other.

Another volute housing constructed in accordance with this invention is illustrated in FIG. 12 and is generally designated by the reference numeral 110.

Structure of the volute housing 110 which is identical to that of the volute housing 10 has been double primed.

The volute housing 110 includes a housing body defined by a pair of housing parts or halves 111, 112. The housing parts 111, 112 are joined to each other along a generally radial plane (unnumbered) corresponding to the radial plane R of FIGS. 3-5. The housing parts 11, 12 are joined to each other along the radial plane through interlocked edges 113, 114 through pairs of fasteners 115 defined by female fasteners 116 carried by the edge 113 and male fasteners 115 carried by the edge 114.

Figure 13:
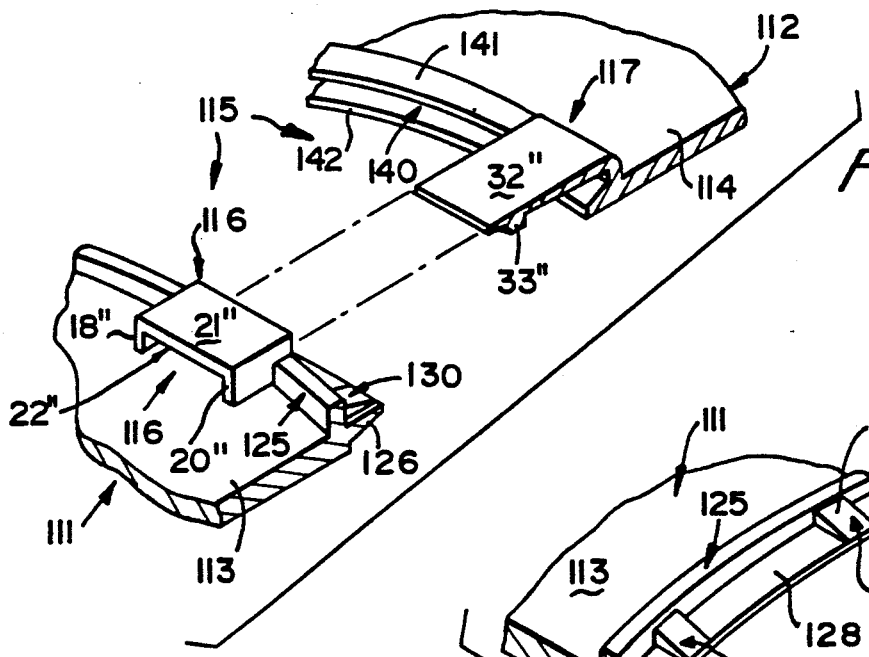
FIG. 13 is a fragmentary enlarged view of a portion of the peripheral edges of the volute housing parts or halves, and illustrates axial alignment of male and female fasteners prior to securing the same to each other, and a nose of one peripheral edge aligned with a channel of the other peripheral edge.

The female fasteners 116 each include a pair of radially projecting spaced legs 18", 20" (FIG. 13) spanned by a bridge 21" and collectively defining a female opening 22". Within each female opening 22" and spaced beneath the bridge 21" thereof is located a generally radially outwardly directed circumferentially extending locking rib 120 having a first inclined surface or face 121, a second inclined surface or face 122, and a top surface or face 123 therebetween. Each of the male fasteners 117 is substantially identical to the male fastener 17' of FIGS. 9 through 11, and includes a tongue or projection 32", a radially inwardly directed locking lip 33" and a surface 108" which locks against the surface 122 of the locking rib 120 when the pairs of fasteners 115 are fastened together in the manner clearly evident in FIG. 15. The assembly and disassembly of the pairs of fasteners 115 need not be described further since the same corresponds to that heretofore described relative to the pairs of fasteners 15' of FIGS. 9 through 11.

Figure 14:
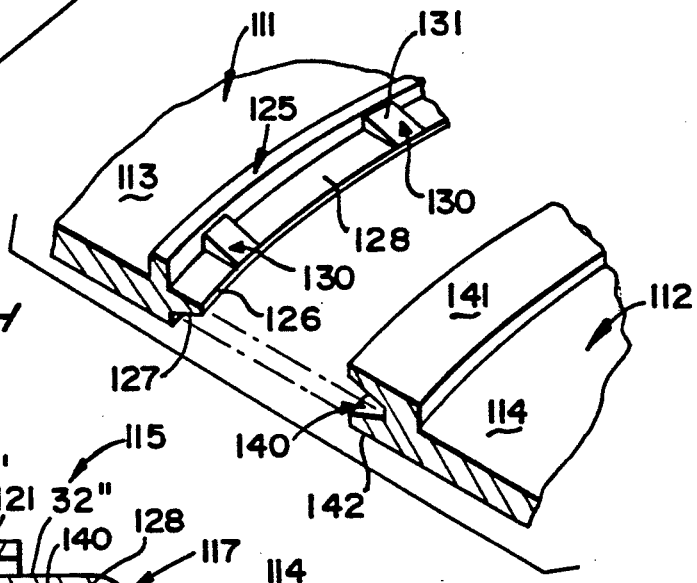
FIG. 14 is a fragmentary perspective view similar to FIG. 13, and illustrates a plurality of circumferentially spaced reinforcing bosses carried by one of the peripheral edges.
Figure 15:
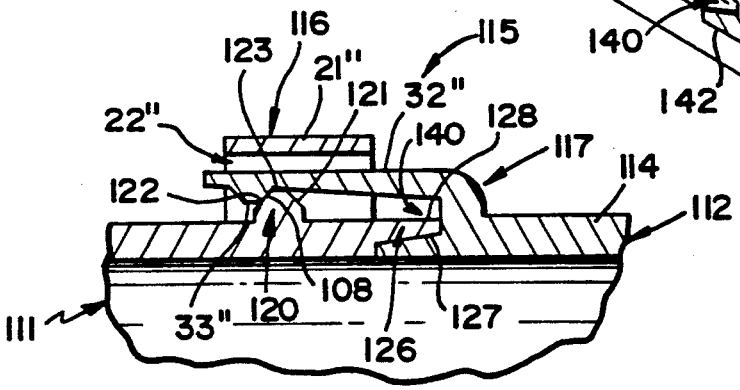
FIG. 15 is a fragmentary cross sectional view illustrating the assembled condition of the volute housing body and illustrates the fasteners interconnected to each other with a nose received in a slot or groove.
Figure 16:
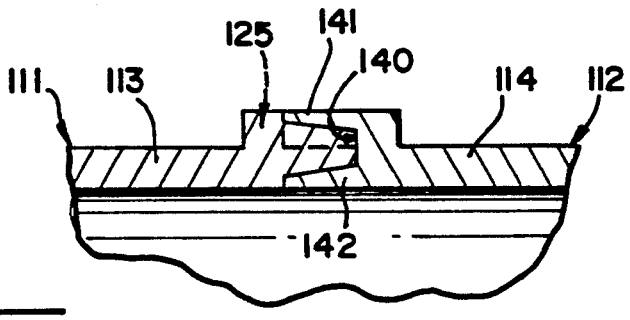
FIG. 16 is a fragmentary cross sectional view similar to FIG. 5, and illustrates the mating configuration between the groove and one of the bosses.

The edge 113 also includes a circumferentially extending radially outwardly directed reinforcing rib 125 forward from which projects a nose 126 having a tapered bottom surface 127 and a relatively flat upper surface 128 (FIGS. 14 and 15). A plurality of reinforcing bosses 130 are spaced peripherally from each other, and each includes an upper tapered surface 131. The surfaces 127, 131 merge at a circumferential flat front surface or face 132. The surfaces 127, 131 and 132 are of a transverse cross sectional configuration (FIG. 16) which corresponds to an axially outwardly opening groove or channel 140 defined between a pair of flanges 141, 142 (FIGS. 13 and 16) of the edge 114. The surfaces (unnumbered) of the channel or groove 140 mates with the surfaces 127, 131 and 132, and lends rigidity to the volute housing 110 when the volute parts 111, 112 are held together by the fasteners 115. Since the volute housing parts 111, 112 are formed from injection molded plastic, the tendency thereof is to deflect or warp, particularly along the edges 113, 114 unless otherwise provided for. The spaced bosses 130 and the rib 125 provide both axial and circumferential rigidity to the edge 113 which prevents the same from warping and thus maintains its rigidity over the lifetime thereof. Obviously since the edge 113 is extremely rigid and relatively nondeflectable, once the interlock of FIGS. 15 and 16 is effected between the nose 126 and the groove 140, the rigidity inherent in the edge 113 also rigidifies the interlock and thus the overall connection about the entire periphery of the housing parts 11, 112 along the entire interlock edges 113, 114.

Though the volute housings 10 (FIG. 1) and 110 (FIG. 12) have been described as being formed of two volute parts or bodies 11, 12 and 111, 112, respectively, the same can be made of more numbers of parts, though the same are preferably divided along planes parallel to the radial plane R (FIGS. 3 and 4). For example, two planes R1, R2 (FIGS. 3 and 4) are illustrated, one to either side of the radial plane R. In accordance with this invention the entire portion of the volute housing 10 located between the radial planes R1, R2 could be a single piece of injection molded plastic material, as would be the housing portions to the left and right of the radial planes R1, R2, respectively. These three parts then could be glued together or adjoining parts could be provided with pairs of fasteners, such as the fasteners 15. As an alternative construction, the parts of the volute housing 10 to the left and right, respectively, of the radial planes R1, R2 can be made of injection molded plastic material, whereas the part of the volute housing 10 between the radial planes R1, R2 can be made of galvanized metal. The peripheral edges of the housing parts to the left and right of the radial planes R1, R2, respectively, could be provided with grooves into which would be received the peripheral edges of the galvanized central part, and these could all be appropriately glued to each other. In this fashion one need but mold opposite axial ends of the volute housing 10 and a central portion could be varied in axial length to accommodate different impellers of different axial length.

Although a preferred embodiment of the invention has been specifically illustrated and described herein, it is to be understood that minor variations may be made in the apparatus without departing from the spirit and scope of the invention as defined in the appended claims.

I claim:

1. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber and progressively increasing to a maximum radial dimension located at a second zone adjacent a throat of said volute chamber, said housing body being defined by a pair of housing parts joined to each other along opposing peripheral edges at a radial plane generally normal to said coincident axis and between said sidewalls, at least one male fastener carried by one of said housing parts and at least one female fastener carried by the other of said housing parts, said female fastener being defined by a pair of generally radially outwardly projecting legs and a bridge therebetween defining a female opening, a ledge adjacent said opening, said male fastener including a generally axially projecting tongue aligned for entry into and removal from said female opening, a generally radially inwardly directed lip carried by said tongue which is adapted to lock against said ledge, said lip and ledge having locking surfaces in contact with each other in a locked condition of said lip and ledge, said locking surfaces when in contact with each other lie in a common plane defining an acute angle with at least one of the directions of entry and removal of said tongue relative to said opening, and said acute angle opens in the direction of tongue removal movement.

2. The volute housing as defined in claim 1 wherein one of said peripheral edges includes a generally peripherally extending axially opening channel, and another of said peripheral edges includes a generally peripherally extending axially projecting nose, and said nose is seated in said channel.

3. The volute housing as defined in claim 1 including a plurality of peripherally spaced axially projecting means carried by said another peripheral edge for reinforcing the same.

4. The volute housing as defined in claim 1 wherein an axially outwardly opening circumferentially extending groove of a first of said opposing peripheral edges receives thereon an axially outwardly projecting circumferentially extending nose of a second of said peripheral edges.

5. The volute housing as defined in claim 4 wherein said at least one male fastener is carried by said first peripheral edge and said at least one female fastener is carried by said second peripheral edge.

6. The volute housing as defined in claim 1 wherein an axially outwardly opening circumferentially extending groove of a first of said opposing peripheral edges receives thereon an axially outwardly projecting circumferentially extending nose of a second of said peripheral edges, and a plurality of axially projecting reinforcing bosses disposed in circumferentially spaced relationship along said nose for reinforcing the same.

7. The volute housing as defined in claim 6 wherein said at least one male fastener is carried by said first peripheral edge and said at least one female fastener is carried by said second peripheral edge.

8. The volute housing as defined in claim 1 wherein an axially outwardly opening circumferentially extending groove of a first of said opposing peripheral edges receives thereon an axially outwardly projecting circumferentially extending nose of a second of said peripheral edges, and said ledge is a circumferentially radially outwardly directed rib.

9. The volute housing as defined in claim 8 wherein said at least one male fastener is carried by said first peripheral edge and said at least one female fastener is carried by said second peripheral edge.

10. The volute housing as defined in claim 1 wherein said female fastener includes an upper surface inclined axially outwardly and radially inwardly to facilitate sliding movement of said lip therealong during tongue entry movement.

11. The volute housing as defined in claim 1 wherein said at least one male fastener is carried by a first of said peripheral edges and defines therewith an axially outwardly opening groove, and a second of said peripheral edges is seated in said groove in the locked condition of said lip and ledge.

12. The volute housing as defined in claim 1 wherein said side walls have first side wall portions disposed generally in parallel relationship to each other from said first zone toward a transition zone between said first and second zones, and said side walls have second side wall portions in diverging relationship to each other from said transition zone to said second zone, whereby fluid travelling toward said throat expands progressively axially outwardly as it flows between and along said second side wall portions.

13. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber and progressively increasing to a maximum radial dimension located at a second zone adjacent a throat of said volute chamber, said housing body being defined by a pair of housing parts joined to each other along a radial plane generally normal to said coincident axis and between said sidewalls, at least one male fastener carried by one of said housing parts and at least one female fastener carried by the other of said housing parts, said female fastener being defined by a pair of generally radially outwardly projecting legs and a bridge therebetween defining a female opening, a ledge adjacent said opening, said male fastener including a generally axially projecting tongue aligned for entry into and removal from said female opening, a generally radially inwardly directed lip carried by said tongue which is adapted to lock against said ledge, said lip and ledge having locking surfaces in contact with each other in a locked condition of said lip and ledge, said locking surfaces when in contact with each other lie in a common plane defining an acute angle with at least one of the directions of entry and removal of said tongue relative to said opening, and said acute angle opens in the direction of tongue removal movement.

14. The volute housing as defined in claim 13 wherein said ledge is disposed within said opening.

15. The volute housing as defined in claim 14 wherein said ledge and tongue have respective locking surfaces which are in abutment with each other when said tongue and ledge are locked together, and said locking surfaces are disposed in transverse nonnormal relationship to said coincident axis.

16. The volute housing as defined in claim 13 wherein said ledge and tongue have respective locking surfaces which are in abutment with each other when said tongue and ledge are locked together, and said locking surfaces are disposed in transverse relationship to said coincident axis.

17. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber and progressively increasing to a maximum radial dimension located at a second zone adjacent a throat of said volute chamber, said housing body being defined by a pair of housing parts joined to each other along opposing peripheral edges at a radial plane generally normal to said coincident axis and between said sidewalls, at least one male fastener carried by one of said housing parts and at least one female fastener carried by the other of said housing parts, an axially outwardly opening circumferentially extending substantially U-shaped in cross-section groove of a first of said opposing peripheral edges receives therein an axially outwardly projecting circumferentially extending nose of second of said peripheral edges, and a plurality of axially extending reinforcing bosses carried by said nose and disposed in circumferentially spaced relationship along said nose for reinforcing the same.

18. The volute housing as defined in claim 17 wherein said side walls have first side wall portions disposed generally in parallel relationship to each other from said first zone toward a transition zone between said first and second zones, and said side walls have second side wall portions in diverging relationship to each other from said transition zone to said second zone, whereby fluid travelling toward said throat expands progressively axially outwardly as it flows between and along said second side wall portions.

19. The volute housing as defined in claim 17 wherein the axial cross-sectional configuration through any boss and nose defines a substantially U-shaped cross-section corresponding substantially to the U-shaped cross-section of said groove.

20. The volute housing as defined in claim 18 wherein the axial cross-sectional configuration through any boss and nose defines a substantially U-shaped cross-section corresponding substantially to the U-shaped cross-section to said groove.

* * * * *